United States Patent [19]

Hughes et al.

[11] Patent Number: 4,682,661

[45] Date of Patent: Jul. 28, 1987

[54] DRILLING APPARATUS

[76] Inventors: Philip M. Hughes, 31 Marlborough Drive, Tytherington, Macclesfield, Cheshire; Michael W. McHugh, 3 Sulby Road, Thorplands, Northampton, both of Great Britain

[21] Appl. No.: 594,562

[22] Filed: Mar. 29, 1984

[30] Foreign Application Priority Data

Mar. 31, 1983 [GB] United Kingdom ..... 8309016

[51] Int. Cl.[4] ..... E21B 17/18; E21B 21/10; E21B 21/12

[52] U.S. Cl. ..... 175/215; 137/512.1; 137/515; 166/325; 175/318; 175/324; 175/400

[58] Field of Search ..... 175/215, 400, 324, 213, 175/318, 393; 166/325; 137/512.1, 515

[56] References Cited

U.S. PATENT DOCUMENTS

| | | | |
|---|---|---|---|
| 1,054,794 | 3/1913 | Riegel | 137/512.1 |
| 1,388,496 | 8/1921 | Wadsworth | 175/318 |
| 1,547,461 | 7/1925 | Steele | 175/215 |
| 1,587,877 | 6/1926 | Vaughn | 137/512.1 |
| 2,891,571 | 6/1959 | Sparks | 137/512.1 |
| 3,077,358 | 2/1963 | Costa | 175/324 |
| 3,360,061 | 12/1967 | Canalizo | 175/215 |
| 3,807,514 | 4/1974 | Murrell | 175/215 |
| 3,951,220 | 4/1976 | Phillips, Jr. et al. | 175/393 |
| 4,321,974 | 3/1982 | Klemm | 175/215 |

*Primary Examiner*—James A. Leppink
*Assistant Examiner*—Hoang C. Dang
*Attorney, Agent, or Firm*—Stiefel, Gross, Kurland & Pavane

[57] ABSTRACT

A boring head for duo-pipe drilling apparatus comprises a body having a passage for material return extending therethrough from the cutting end to the coupling end, the passage having an inlet at the cutting end displaced from the axis of rotation of the head and extending substantially across the full radius thereof, and an exit at the coupling end co-axial with the axis of rotation. The cutting end comprises one or more teeth having attacking edges overlying the inlet and beveled for mechanically displacing material into the inlet upon rotation of the head. Fluid supply galleries open into the passage for directing pressurized fluid from the duo-pipe system towards the exit of the passage for flushing cut material to the exit. The coupling end of the boring head is adapted for connection to the duo-pipe system with the annular passage of the duo-pipe system in communication with the fluid supply galleries and with the inner tube of the duo-pipe system in communication with the exit of the passage.

An improved valving arrangement for avoiding the backflow of fluids or solids into the annular passage of the duo-pipe system is also disclosed.

8 Claims, 5 Drawing Figures

DRILLING APPARATUS

FIELD OF THE INVENTION

This invention relates to a boring head for earth drilling apparatus and in particular to a boring head for earth drilling apparatus employing a duo-pipe system for sampling underground deposits.

BACKGROUND OF THE INVENTION

There are several drilling techniques which may be employed for sampling underground deposits, e.g. sands and gravels. The particular choice of technique is governed by the ground conditions, the technical objectives and a foreknowledge of the water table conditions. In hard rock, the diamond coring technique is used, and the competence of the strata usually prevents contamination of samples. However, in soft rock, e.g. superficial sands and sand-rock, the strata are likely to collapse into the bore hole, particularly under wet conditions. In extreme cases this phenomenon is known as "running sand".

One drilling technique which has been used for soft strata employs continuous flight augers which involves the sinking of an unprotected hole, with the augers pumping material from the strata below to the surface. Whilst this drilling technique has the advantage of speed, contamination is likely to occur beneath the regional water table or beneath perched water tables. Accordingly, no great confidence can be placed in the samples by this technique.

An alternative technique is "shell and auger" drilling using a percussive method. In this technique the bore hole is advanced by casing, with material from within the casing being delivered to the surface by a cutting cylinder attached to a cable and winch. The technique is usually very slow and in cases of running sand may fail completely. However, the advantage of the technique is that under many conditions greater confidence can be placed in the samples derived from below water tables, as the bore hole is sealed off from in-flow of material from levels above the cutting area.

A further technique which may be used for sampling underground deposits employs a duo-pipe system. This system combines the flushing mechanisms usually associated with diamond coring with the principle of casing the bore hole. The system comprises two concentric tubes attached to the boring head arranged in such a way as to allow fluid under pressure to pass down the annular passage between the tubes whilst they are rotated together during the drilling operation. A series of galleries is provided at the boring head which allows the fluid under pressure to escape into the inner tube in such a manner that any particles of cut material in the region of the galleries are entrained in the fluid flow and transported to the surface through the inner tube for collection and analysis. A small proportion of the fluid under pressure may be circulated to the base of the boring head for cooling and dissipates up the outside of the tubes creating a useful pressurised environment countering any tendancy for downward flow in this area.

Heretofore, the boring heads which have been employed in such duo-pipe systems have generally been provided with an inlet for cut material which is coaxial with the axis of rotation of the boring head. The cutting teeth of the boring head are generally disposed around this material inlet. The fluid supply galleries in boring head are normally directed at right angles to the passage for material return or are directed towards the cutting face relying upon a back pressure building up against the cutting face to divert the fluid up the return pipe. It has been found that this arrangement is not always efficient in flushing cut material to the surface for analysis, particularly when the boring head penetrates clay or gravel and this inefficiency may result in contamination of the samples collected.

SUMMARY OF THE INVENTION

In accordance with the present invention there is provided a boring head for duo-pipe drilling apparatus of the type described, the boring head comprising:

a body having a coupling end and a cutting end, a passage for material return extending through the body from the cutting end to the coupling end, said passage having an inlet at the cutting end displaced relative to the intended axis of rotation of the head and an exit at the coupling end which is coaxial with the intended axis of rotation of the head, the cutting end comprising cutting means constructed and arranged such that in use cut material is mechanically displaced into the inlet of the passage for material return, fluid supply galleries opening into said passage for material return so as to direct fluid flow towards the exit of said passage to flush cut material in said passage to the exit, the coupling end of the boring head being adapted for connection to a duo-pipe system such that the annular passage for pressurised fluid of the duo-pipe system is in communication with the fluid supply galleries of the boring head and the inner tube of the duo-pipe system is in communication with the exit of the passage for material return of the boring head.

The boring head of the invention provides significant advantages over boring heads used in the prior art in that it ensures that the cut material passes immediately into the passage in the boring head due to the rotational movement of the head and the arrangement of the cutting edge and inlet for material and thereafter it is entrained in the fluid flow passing from the galleries into the main passage and directed towards the exit. The invention utilises both the mechanical displacement of material during the drilling operation as well as the flow of pressurised fluid to force the cut material through the boring head and thence up the inner return tube which provides significant improvements over the prior art which primarily utilises the pressurised fluid. Furthermore, since the cut material is immediately forced into the inlet of the main passage during a drilling operation, contamination of the sample is reduced to a minimum and great confidence may be placed in the samples collected.

In accordance with one embodiment of the invention the cutting means comprises one or more teeth positioned on the bottom of the boring head such that the attacking edge of the teeth overlies the inlet of the passage for material return. The attacking edge of the teeth are preferably bevelled to enhance the cutting action and facilitate passage of cut material into said inlet. The attacking edges of the teeth preferably comprise a very hard material, e.g. tungsten carbide. The teeth may be linear and/or staggered in the horizontal and vertical planes.

The passage for material returned in the boring head is preferably a cylindrical bore the longitudinal axis of which is inclined at an angle to the axis of rotation of the head. The cylindrical bore preferably has a diameter identical to that of the inner return pipe.

The fluid supply galleries are in communication with the annular passage in the drill stem to receive a supply of compressed fluid and open into the passage for material return in the drill head such that the fluid flow discharging from the galleries is directed towards the exit of the passage for material return. Preferably, there are at least six, more preferably at least 12, fluid supply galleries opening into the passage for material return within the boring head. The fluid supply galleries may conveniently be inclined at an angle in the range 30° to 60°, preferably about 45°, to the rotational axis of the boring head.

Whilst the boring head described above may be used in combination with duo-pipe system to deliver uncontaminated samples to the surface, problems of contamination may arise or in drilling beneath the regional water table or perched water table. In such situations, a back pressure may develop which, after the pressurised fluid supply is turned off, e.g. to allow the addition of further drilling rods, etc., may force fluid and/or solids into the outer annular passage of the drill stem via the passage for material return and fluid supply galleries in the boring head. If this material becomes sufficiently compacted the pressurised fluid supply may be unable to clear the blockage and accordingly it will be necessary to retrieve the boring head before drilling and sampling can be started. The inclusion of a valve mechanism between the coupling end of the boring head and the duo-pipe system to prevent the flow of fluids or solids into the annular passage of the drill stem from the fluid supply galleries ensures the annular passage is kept clear at all times. This allows the penetration of strata and collection of uncontaminated samples from below regional or perched water tables.

A suitable valve mechanism for use with the boring head comprises:

an outer cylindrical body having one end adapted for coupling to the boring head and a second end adapted for coupling to the outer rod of a duo-pipe system, an inner cylindrical body, concentric with the outer cylindrical body, having one end adapted for coupling to the boring head and a second end adapted for coupling with the inner pipe of a duo-pipe system, the inner and outer bodies defining an annular passage, a series of three or more rings which are located within said annular passage, each ring extending from the inner cylindrical surface of the outer body to the outer cylindrical surface of the inner body, the rings comprising an intermediate ring defining a plurality of passages therethrough, each passage having therein a sphere having a diameter less than the bore of the passage and composed of a material having a specific gravity less than 1, an upper ring positioned on that side of the intermediate ring nearer the end adapted for coupling to the duo-pipe system, said upper ring defining a plurality of passages corresponding to those in the intermediate ring, said passages in the upper ring having a bore less than the diameter of the spheres, and a lower ring positioned on the side of the intermediate ring nearer the end adapted for coupling to the boring head, said lower ring having a plurality of series of ducts each duct having a bore which is small compared to the diameter of the spheres, each series of ducts being arranged in communication with a respective passage in the intermediate ring, whereby pressurised fluid may pass through the valve mechanism via the upper intermediate and lower rings respectively but passage of pressurised fluid through the valve mechanism via the lower ring, intermediate ring and upper ring is prevented by each sphere sealing the respective passage in the upper ring.

DETAILED DESCRIPTION OF THE DRAWINGS

The invention will now be described with reference to the accompanying drawings, in which.

Figure 1:
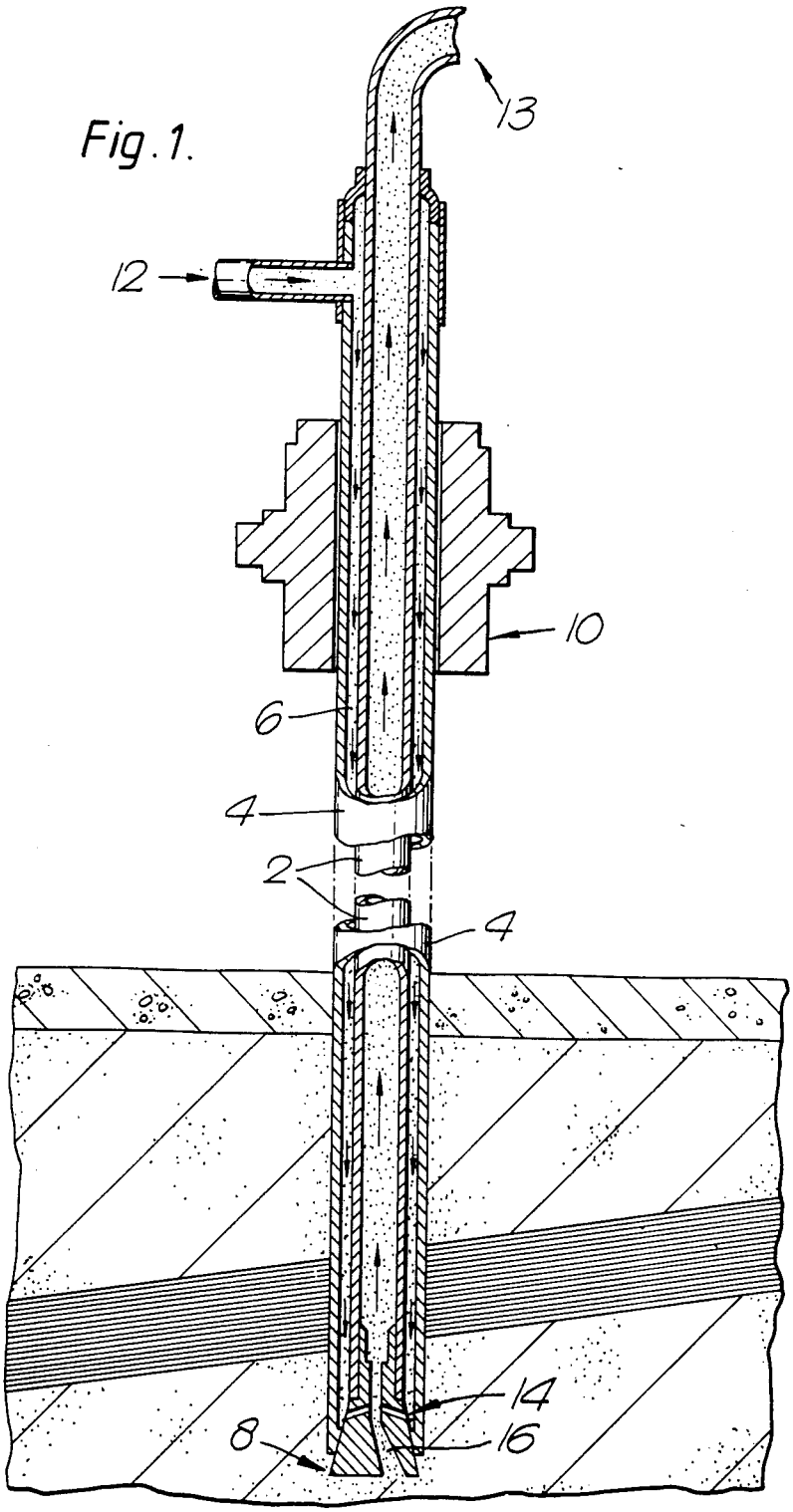
FIG. 1 represents a sectional view of the duo-pipe system suitable for use with the boring head of the invention.

FIG. 1 illustrates a duo-pipe system in which the drill stem comprises an inner return pipe 2 and a concentric outer tube 4 defining therebetween an annular passage 6 for pressurised fluid. The drill stem terminates in a boring head 8. A top drive head 10 is provided for rotation of the drill stem and boring head and application of downward pressure to effect the drilling operation.

An inlet 12 is provided at the upper end of the outer tube 4 for pressurised fluid. Preferably, the pressurised fluid is pressurised air although water or other liquid, mist and foam may be utilised if desired. Typical pressures are in the range $3.5\times10^4$ to $1.0\times10^5$ kg/m$^2$. The pressurised fluid passes down the annular passage 6 between the inner pipe 2 and outer tube 4 and through galleries 14 in the boring head 8 entraining any cut material present in the passage for material return 16 within the boring head. The entrained material passes up the inner return pipe and may be collected via the exits 13 by any suitable means, e.g. a container or via a cyclone The boring head 8 illustrated in FIGS. 2 and 3 comprises a body 20 having a coupling end 22 and a cutting end 24. The passage for material return 16 has an exit 28 at the coupling end 22 which is coaxial with the axis of rotation X of the head 8 and an inlet 30 which is displaced relative to the axis of rotation.

The galleries 14 in the boring head 8 comprise ducts 32 extending axially through the boring head, opening at one end into an annular chamber 33 which is in communication with the annular passage 16 of the duo-pipe system. The exit ports 34 of the galleries 14 are in communication with the ducts 32 and are disposed to provide an airflow directed across the exit 28 of the passage 16. The exit ports 34 generally make an angle of 30° to 60° with the axial direction of the boring head, preferably about 45°. The ducts 32 are generally arranged circumferentially around the passage 16 and each duct may be associated with one or more exit ports in order to establish a rising curtain of pressurised fluid to entrain cut material and transport the material up the inner return pipe of the duo-pipe system. The bore of the ducts and exit ports may be varied in order to optimise the flushing of material through the boring head. If desired, additional ducting (not shown) may be included to direct a portion of the fluidised pressure to the cutting face 24 of the boring head for cooling purposes.

The coupling end 22 of the boring head is constructed and arranged such that the exit 28 of the passage is in communication with the inner return pipe 2 and the ducts 32 are in communication with the annular passage between the duo-pipes. The coupling end is designed to maintain a gas tight seal between the boring head and duo-pipe system whilst maintaining the pressurised fluid supply in the annular passage separate from the inner return pipe.

In the embodiment illustrated the coupling end 22 of the boring head includes abutments 35 and 36 adapted to engage the ends of the inner and outer pipes respectively of the duo-pipe system or an intermediate connecting sleeve. The boring head may be secured to the duo-pipe system or connecting sleeve with longitudinal extending bolts passing through bores 37. Other connection means may also be utilised, e.g. threads, etc.

Figure 2:
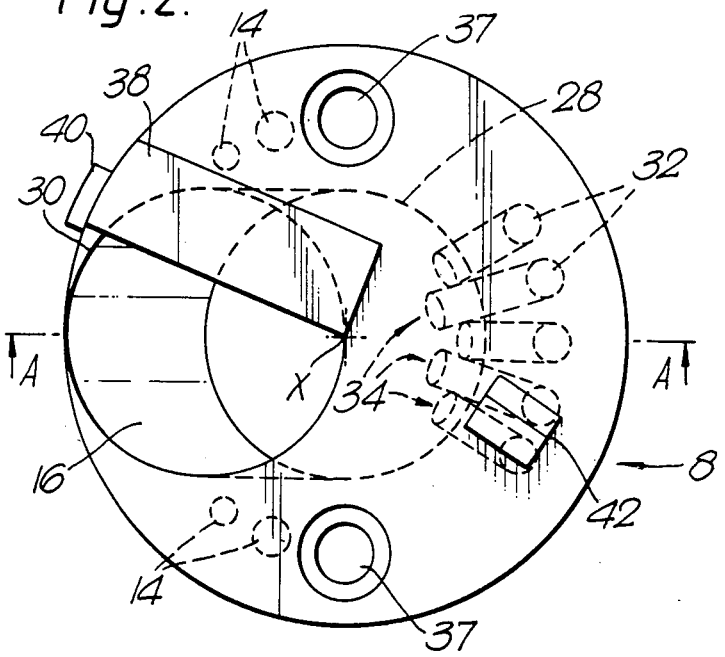
FIG. 2 represents an underneath plan view of a boring head in accordance with the invention.
Figure 3:
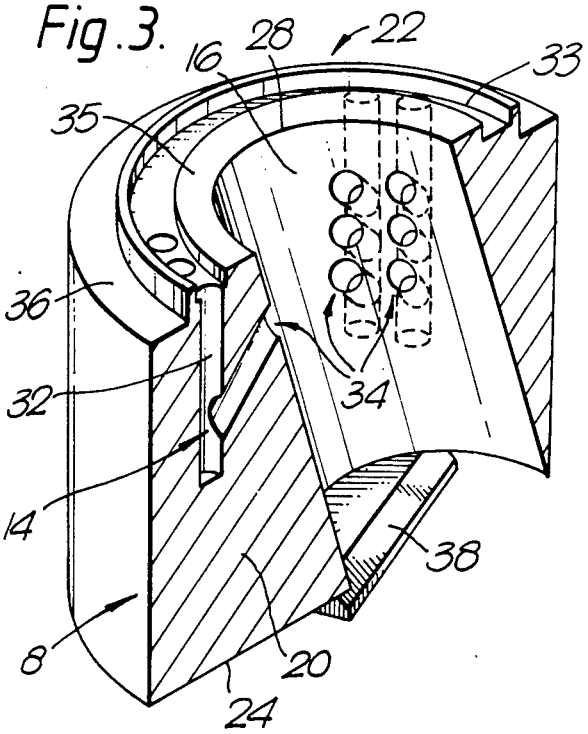
FIG. 3 represents a sectional perspective view of the boring head of FIG. 2 along the line A—A.

The cutting end 24 of the boring head is provided with one or more cutting teeth generally shown at 38 extending over the inlet 30. Whilst FIGS. 2 and 3 show a single tooth, two or more teeth may be utilised which may be arranged in a linearly or staggered relationship in vertical and horizontal planes. The teeth are shaped such that cut material is forced mechanically into the inlet 30 due to the rotation of the boring head. The teeth are preferably composed of tungsten carbide and may be welded to the boring head or fixed with securing means, e.g. screws or bolts, which may be recessed into the teeth.

Figure 4:
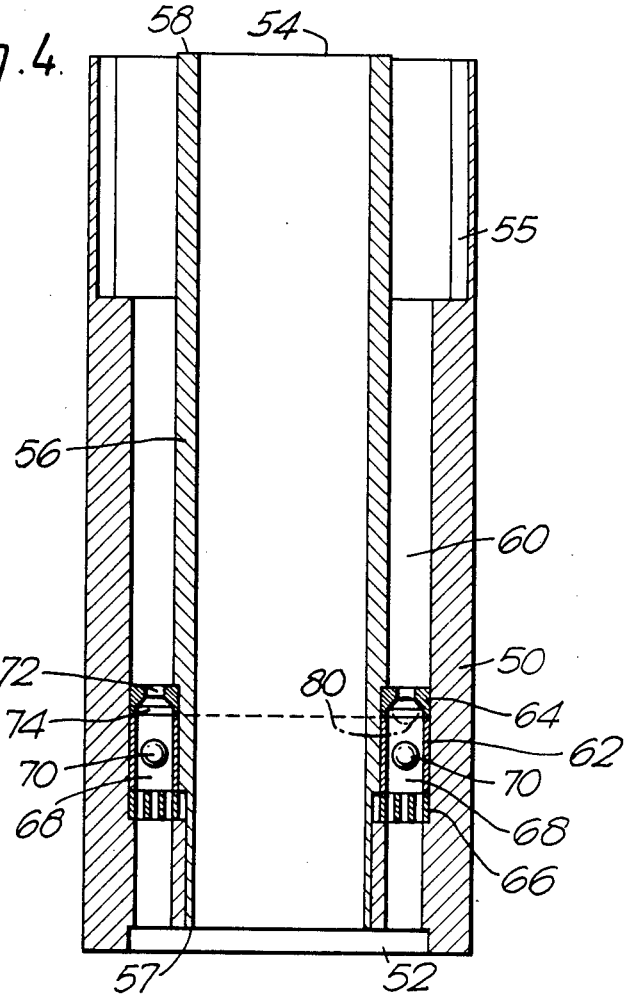
FIG. 4 represents a longitudinal section through a valve mechanism suitable for use in the invention.
Figure 5:
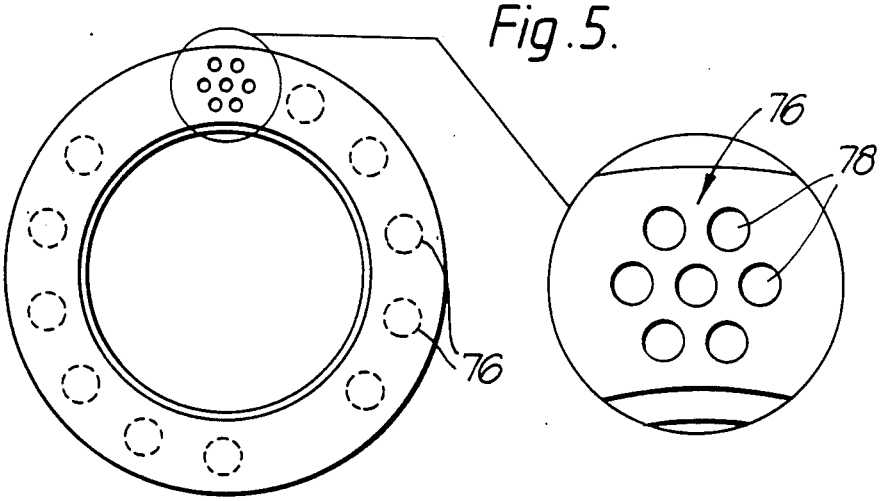
FIG. 5 represents a plan view of the lower ring of the valve mechanism shown in FIG. 4.

A reaming tooth 40 may be provided on the side of the boring head, preferably adjacent the cutting tooth 38. The reaming tooth extends slightly beyond the cylindrical periphery of the body of the boring head creating a bore in the strata slightly larger than that of the cylindrical portion of the boring head and outer tube of the duo-pipe system in order to reduce friction between the strata and the drill stem during rotation A further cutting tooth 42 may be provided on that side of the cutting end of the boring head diametrically opposite the tooth 38. Cutting tooth 42 assists in balancing the boring head during rotation thereby allowing a smoother cutting action FIGS. 4 and 5 of the accompanying drawings illustrate a valve arrangement suitable for use in combination with the boring head of the invention The valve mechanism prevents fluid from entering the annular passage of the duo-pipe system via the boring head when the source of pressurised fluid is removed. The valve mechanism comprises an outer cylindrical body 50 having one end 52 adapted for coupling to the boring head and a second end 54 adapted for coupling to the outer pipe of a duo-pipe system, in the embodiment shown an internal thread 55 is provided An inner cylindrical body 56 having cne end 57 adapted for coupling to the boring head and a second end 58 adapted for coupling to the inner pipe of the duo-pipe system. A valve arrangement is located in the annular passage 60 between the cylindrical bodies 50 and 56 comprising three rings 62, 64, 66. The intermediate ring 62 has a plurality of passages 68 therethrough, each passage accommodating a sphere 70 having a diameter smaller than the bore of each respective passage 68 such that the sphere is freely movable within the bore The spheres comprise a low specific gravity material having a maximum specific gravity of less than 1. Suitable materials include polystyrene or similar plastics materials. The upper ring 64 is provided with a plurality of passages 72 therethrough which are aligned with the passages 68 in the intermediate ring. The bore of the passages 72 is smaller than the diameter of the spheres 70. The opening of the bore 72 facing the sphere may be flared or countersunk as shown at 74.

The lower ring 66 is provided with a plurality of series 76 of ducts 78 each series being associated with a passage 68 in the intermediate ring 62. The bore of the ducts is substantially less than the diameter of the spheres.

In use, when pressurised fluid is passed down the annular passage of the duo-pipe system the pressurised fluid will pass through the annular passage 60 and into the valve mechanism via passages 72. The spheres 70 will rest on the lower ring 66 but will leave one or more of the ducts 78 uncovered thereby allowing the pressurised fluid to pass through the valve mechansim to the ducts and galleries of the boring head. When the source of pressurised fluid is removed, if fluid, e.g. water, enters the valve mechanism via the boring head, the fluid will pass through the ducts 78 into the passages 68. The low specific gravity spheres will rise in the passage 68 under the influence of the incoming fluid to a position shown in outline at 80 whereby the passages 72 in the upper ring are sealed, thereby preventing passage of fluid through the valve mechanism into the annular passage of the duo-pipe system.

The boring apparatus of the invention generally employs pressurised air as the pressurised fluid for returning the cut material to the surface. The drill stem is composed of a series of lengths of duo-pipe sections, e.g. 1.5 or 3 meters in length. A preferred drilling technique for ensuring accurate sampling is to flush the cut material to the surface whilst increasing the depth of the bore hole by a duo-pipe section. When a new duo-pipe section is added it is necessary to disconnect the pressurised air supply and the valve mechanism will be operational to ensure the annular passage remains unblocked. When a new duo-pipe section has been added, but before drilling, it is preferable to purge the boring head and passage for material return by injecting a slug of water into the annular passage and passing the slug of water through the annular passage, fluid supply galleries and passage for material return under the effect of pressurised air. The water and any contaminants flushed from the system are discarded. Thus, when drilling commences the boring head and passage for material return will be cleansed. Drilling may take place, e.g. increasing the depth of the bore hole by the length of newly added section, and all of the cut material returned to the surface during the drilling operation represents the material displaced from the new length of the bore hole. Thus, great confidence may be placed upon the sample obtained.

We claim:

1. A boring head for duo-pipe drilling apparatus of the type comprising concentric inner and outer pipes defining an annular passage therebetween for transmitting pressurised fluid to the boring head, the boring head comprising;

a body having a coupling end and a cutting end;

a passage for material return extending through the body from the cutting end to the coupling end, said passage having an inlet at the cutting end displaced relative to the intended axis of rotation of the boring head and extending radially across substantially the full radius of the boring head, and an exit at the coupling end which is coaxial with the intended axis of rotation of the boring head;

means at the cutting end comprising at least one cutting tooth having an elongate attacking edge substantially perpendicular to said axis and overlying said inlet, said tooth having a forward portion bevelled rearwardly from said edge for mechanically displaying material cut by said at least one cutting tooth into said inlet as said boring head is rotated;

fluid supply galleries in said body opening into said passage for material return for directing fluid towards the exit of said passage to flush cut material in said passage to the exit;

the coupling end of the boring head being adapted for connection to a duo-pipe system such that the annular passage for pressurised fluid of the duo-pipe system is in communication with the fluid supply galleries and the inner pipe of the duo-pipe system is in communication with the exit of the passage for material return.

2. A boring head as claimed in claim 1, characterised in that the passage for material return comprises a cylindrical bore, the longitudinal axis of which is inclined at an angle to the axis of rotation of the head.

3. A boring head as claimed in claim 1, characterised in that the fluid supply galleries comprise exit ports opening into the passage for material return at an angle of from 30° to 60° with the axial direction of the boring head.

4. A boring head as claimed in claim 1, characterised in that the fluid supply galleries comprise exit ports opening into the passage for material return at an angle of about 45° with the axial direction of the boring head.

5. A boring head as claimed in claim 1, characterised in that the cutting means additionally comprises a reaming tooth positioned at the periphery of the boring head.

6. A boring head as claimed in claim 1, characterised in that the coupling end of the boring head is in direct communication with valve means for preventing flow of fluid into the annular passage of the duo-pipe system via the fluid supply galleries of the boring head.

7. A boring head as claimed in claim 6, characterised in that the valves means comprises:

an outer cylindrical body having one end adapted for coupling to the boring head and a second end adapted ior coupling tothe outer pipe of the duo-pipe system, an inner cylindrical body, concentric with the outer cylindrical body, having one end adapted for coupling to the boring head and a second end adapted for coupling with the inner pipe of the duo-pipe system, the inner and outer bodies defining an annular passage, a series of three or more rings which are located within said annular passage, each ring extending from the inner cylindrical surface of the outer body to the outer cylindrical surface of the inner body, the rings comprising:

an intermediate ring defining a plurality of passages therethrough, each passage having therein a sphere having a diameter less than the bore of the passage and composed of a material having a specific gravity less than 1, an upper ring positioned on that side of the intermediate ring nearer the end adapted for coupling to the duo-pipe system, said upper ring defining a plurality of passsges corresponding to those in the intermediate ring, said passages in the upper ring having a bore less than the diameter of the spheres, and a lower ring positioned on the side of the intermediate ring nearer the end adapted for coupling to the boring head, said lower ring having a plurality of series of ducts each duct having a bore which is small compared to the diameter of the spheres, each series of ducts being arranged in communication with a respective passage in the intermediate ring, whereby pressurised fluid may pass through the valve mechanism via the upper intermediate and lower rings respectively but passage of pressurised fluid through the valve mechanism via the lower ring, intermediate ring and upper ring is prevented by each sphere sealing the respective passage in the upper ring.

8. A valve mechanism suitable for use in a duo-pipe system of the type comprising concentric inner and outer pipes defining an annular passage therebetween, the valve mechanism comprising;

an outer cylindrical body having one end adapted for coupling to the boring head and a second end adapted for coupling to the outer pipe of the duo-pipe system, an inner cylindrical body, concentric with the outer cylindrical body, having one and adapted for coupling to the boring head and a second end adapted for coupling with the inner pipe of the duo-pipe system, the inner and outer bodies defining an annular passage, a series of three or more rings which are located within said annular passage, each ring extending from the inner cylindrical surface of the outer body to the outer cylindrical surface of the inner body, the rings comprising:

an intermediate ring defining a plurality of passages therethrough, each passage having therein a sphere having a diameter less than the bore of the passage and composed of a material having a specific gravity less than 1, an upper ring positioned on that side of the intermediate ring nearer the end adapted for coupling to the duo-pipe system, said upper ring defining a plurality of passages corresponding to those in the intermediate ring, said passages in the upper ring having a bore less than the diameter of the spheres, and a lower ring positioned on the side of the intermediate ring nearer the end adapted for coupling to the boring head, said lower ring having a plurality of series of ducts being arranged in communication with a respective passage in the intermediate ring, whereby pressurised fluid may pass through the valve mechanism via the upper intermediate and lower rings respectively but pasage of pressurised fluid through the valve mechanism via the lower ring, intermediate ring and upper ring is prevented by each sphere sealing the respective passage in the upper ring.

* * * * *